US012472411B2

(12) United States Patent
Crisco, III

(10) Patent No.: US 12,472,411 B2
(45) Date of Patent: Nov. 18, 2025

(54) ANTI-ROTATION ELEMENT FOR A LACROSSE GOALIE STICK

(71) Applicant: Joseph John Crisco, III, Barrington, RI (US)

(72) Inventor: Joseph John Crisco, III, Barrington, RI (US)

( * ) Notice: Subject to any disclaimer, the term of this patent is extended or adjusted under 35 U.S.C. 154(b) by 733 days.

(21) Appl. No.: 17/811,901

(22) Filed: Jul. 12, 2022

(65) Prior Publication Data

US 2023/0016872 A1 Jan. 19, 2023

Related U.S. Application Data

(60) Provisional application No. 63/221,849, filed on Jul. 14, 2021.

(51) Int. Cl.

| | |
|---|---|
| ***A63B 59/00*** | (2015.01) |
| ***A63B 59/20*** | (2015.01) |
| ***A63B 60/06*** | (2015.01) |
| *A63B 102/14* | (2015.01) |

(52) U.S. Cl.

CPC ..... *A63B 59/20* (2015.10); *A63B 60/06* (2015.10); *A63B 2102/14* (2015.10)

(58) Field of Classification Search

CPC ..... A63B 59/20; A63B 60/06; A63B 2102/14; A63B 60/12; A63B 60/34; A63B 60/16

USPC ..... 473/446–450, 471–472, 478–489, 513, 473/204

See application file for complete search history.

(56) References Cited

U.S. PATENT DOCUMENTS

| | | | | |
|---|---|---|---|---|
| 5,456,463 | A * | 10/1995 | Dolan | A63B 60/12 473/563 |
| 5,651,744 | A * | 7/1997 | Millon | A63B 60/34 473/513 |
| 6,419,601 | B1 * | 7/2002 | Kenner | A63B 71/141 81/177.1 |
| 9,687,706 | B1 * | 6/2017 | Cormier | A63B 60/12 |
| 11,648,449 | B1 * | 5/2023 | Pfeifer | A63B 60/16 473/513 |
| 2003/0045380 | A1 * | 3/2003 | Tucker, Sr. | A63B 60/10 473/513 |

(Continued)

FOREIGN PATENT DOCUMENTS

| | | | |
|---|---|---|---|
| CA | 2289254 A1 * | 11/1998 | |
| CA | 2538973 A1 * | 9/2006 | A63B 59/20 |

(Continued)

*Primary Examiner* — Kiley S Stoner

(74) *Attorney, Agent, or Firm* — Hinckley, Allen & Snyder, LLP; David Robert Josephs

(57) ABSTRACT

The present invention provides an anti-rotational element, in the form of an adapter, a member integrated into the shaft or integrated into the head that increasing the front-to-back dimension of the stick compared to the side-to-side width dimension of the stick. The increased front-to-back dimension increases the anti-rotational torque that a lacrosse player, particularly a goalie, can generate. As a result, the goalie can prevent the stick from rotating in their hands when shots are off center relative to the longitudinal axis of the shaft thereby allowing the goalie to make saves that would otherwise result in a goal. The invention also aids in instructing goalies to avoid too tightly gripping the stick, which slows a goalies reaction time for a save.

4 Claims, 6 Drawing Sheets

(56) References Cited

U.S. PATENT DOCUMENTS

2005/0043123 A1* 2/2005 Harvey ..... A63B 59/20 473/513
2005/0233839 A1* 10/2005 Adams ..... A63B 60/00 473/513
2005/0282666 A1* 12/2005 Morrow ..... A63B 60/10 473/513
2006/0019777 A1* 1/2006 Rogers ..... A63B 59/20 473/513
2007/0004541 A1* 1/2007 Price ..... A63B 59/20 473/513
2008/0058130 A1* 3/2008 Herman ..... A63B 59/20 29/428
2009/0005197 A1* 1/2009 Mayer ..... A63B 60/06 403/358
2009/0131205 A1* 5/2009 Tucker, Jr. ..... A63B 59/20 473/513
2009/0253539 A1* 10/2009 LoVine ..... A63B 60/42 138/96 R
2009/0264227 A1* 10/2009 Price ..... A63B 59/20 473/513
2009/0298619 A1* 12/2009 Tice ..... A63B 69/0088 473/425
2010/0120561 A1* 5/2010 Clancy ..... A63B 49/08 473/560
2010/0125010 A1* 5/2010 Martin ..... A63B 60/20 473/446
2012/0071280 A1* 3/2012 Copeland ..... A63B 60/00 473/513
2012/0295744 A1* 11/2012 Taylor ..... A63B 60/20 473/513
2013/0029792 A1* 1/2013 Abdelmalek ..... A63B 60/50 403/361
2013/0244816 A1* 9/2013 Lignelli ..... A63B 60/06 473/513
2014/0243120 A1* 8/2014 Chauvin ..... A63B 60/06 473/513
2015/0182829 A1* 7/2015 Morin ..... A63B 60/16 473/513
2015/0238831 A1* 8/2015 McNulty ..... A63B 60/06 29/428
2017/0036080 A1* 2/2017 Thompson ..... A63B 59/20
2017/0120121 A1* 5/2017 Oman ..... A63B 60/34
2018/0015340 A1* 1/2018 Codd ..... A63B 60/24
2018/0178101 A1* 6/2018 Francis ..... A63B 60/02
2018/0207465 A1* 7/2018 Kaye ..... A63B 60/24
2019/0217173 A1* 7/2019 Kaye ..... A63B 1/00
2022/0008797 A1* 1/2022 Underwood ..... A63B 60/54
2025/0099827 A1* 3/2025 Kamins ..... A63B 69/00

FOREIGN PATENT DOCUMENTS

CA 2631988 A1 * 11/2008 ..... A63B 59/20
CA 2632640 A1 * 11/2008 ..... A63B 59/20
CA 2650345 A1 * 5/2010 ..... B25G 1/102
CA 2707891 A1 * 12/2010 ..... A63B 59/70
CA 2998664 A1 * 9/2018 ..... A63B 60/06
CA 2966440 A1 * 11/2018
CA 3079728 A1 * 10/2021 ..... A63B 59/70
CA 3115646 A1 * 10/2021
WO WO-2006074566 A1 * 7/2006 ..... A63B 49/08
WO WO-2016010846 A1 * 1/2016 ..... A63B 53/14
WO WO-2016010853 A1 * 1/2016 ..... A63B 60/12
WO WO-2017044705 A1 * 3/2017 ..... A63B 59/70
WO WO-2017052675 A1 * 3/2017 ..... A63B 59/70
WO WO-2023220231 A1 * 11/2023 ..... A63B 69/3632
WO WO-2024177843 A1 * 8/2024

* cited by examiner

ANTI-ROTATION ELEMENT FOR A LACROSSE GOALIE STICK

CROSS REFERENCE TO RELATED APPLICATION

This application is related to, and claims benefit from, U.S. Provisional Application No. 63/221,849, filed on Jul. 14, 2021, entitled "ANTI-ROTATIONAL LACROSSE GOALIE STICK," incorporated by reference in its entirety, herein.

BACKGROUND OF THE INVENTION

The game of lacrosse and the lacrosse sticks used to play lacrosse are very well known in the art. Men's and women's lacrosse is a fast-paced game played on foot in which field players attempt to pass and catch a ball with a stick that has a pocket in the head of the stick, and a shaft to which the head is affixed. To score the players must shoot the ball into a goal. Each team has a goalie that attempts to make a save by catching the ball with his/her stick before it enters the goal.

As to the sticks used to play lacrosse, there are field sticks used by all players except the goalies, who use specialized goalie sticks. For field sticks, as governed by the rules of lacrosse, the heads used for field sticks are generally the same size but the length of the stick shafts themselves and pocket configuration vary greatly (in men's game, less so in the women's game) depending on the position and personal preferences of the player using the stick. The head frame carries a pocket, which is formed from laces, strings, webbing/netting, 3D printed material and other structures, as is very well known in the art.

On the other hand, a goalie stick has a head that is typically larger than those of field players in order to increase the odds of making a save. As a result a lacrosse goalie stick is used in a different fashion and has playing features, needs and characteristics that are different compared to a typical field lacrosse stick.

The player typically grasps the stick with one hand near the head of the stick and other at a distance down the shaft of the stick. During gameplay, a shot ball being saved by the goalie rarely impacts the head along the axis of the shaft. Shots that impact off center or towards the side or edge of the head generate a torque about the longitudinal axis of the stick. Therefore, the goalie must grip the shaft securely to prevent the undesirable rotational torque. More specifically, since the cross-section of the shaft is generally round where shaft has a cross-sectional length that is substantially the same as the cross-section width, substantial grip strength is required to resist the rotational torque particularly for shots that are at high speed and at the furthermost lateral sides of the head, which generate the most amount of rotational torque. Therefore, it can be quite difficult for the goalie to resist this rotational toque by gripping the shaft, and making a save. As can be understood, if not enough leverage is imparted to the stick, it will spin the stick in their hands and thereby permitting the shot ball to pass by the goalie, which could result in a score.

Therefore, there is a demand for a goalie stick shaft that has an improved cross-sectional profile to make it easier to prevent rotation about the longitudinal axis of the lacrosse goalie stick.

There is a demand for a goalie stick that can reduce the amount of grip strength needed to prevent rotation about the longitudinal axis of the stick.

There is a demand for a goalie stick with an improved configuration that increases a goalies chance of saving the shot.

There is a further demand for an improved construction a goalie lacrosse stick to increase performance.

There is a further demand for the shaft, head or both for a goalie lacrosse stick that improves goalie instruction by teaching the use of less gripping force when preparing for a shot yet still avoiding unwanted torquing of the stick.

SUMMARY OF THE INVENTION

The present invention preserves the advantages of prior art shafts and heads for lacrosse goalie sticks. In addition, it provides new advantages not found in currently available shafts and heads for lacrosse goalie sticks and overcomes many disadvantages of such currently available heads for lacrosse goalie sticks.

In accordance with the present invention, the cross-section of portion of the stick that is gripped by the player is non-symmetrical where the cross-sectional length front to back is more than the cross-sectional width side-to-side. This is significant improvement over prior art goalie sticks that, for example, have cross-sections that have nearly the same cross-sectional length as the cross-sectional width. With the present invention, the non-symmetrical cross-sectional gripped portion of the stick enables the goalie to resist the aforesaid rotational torque thereby improving grip of the shaft, and preventing passage of the ball and, perhaps, making a save when otherwise such a save could not be possible.

Therefore, the present invention relates generally to the lacrosse stick of the goalie that includes an anti-rotation element that is integrated into the shaft of the stick, integrated into the head of the stick or included in an adapter that resides between or on the shaft and the head. Such anti-rotational element can be retrofitted to an existing lacrosse goalie stick. Regardless of how the anti-rotation element is provided or integrated into the stick configuration, a structure is provided for gripping by the goalie that has an increase in the front to back dimension compared to the side to side width dimension to make it easier for the goalie to securely grip the goalie stick to prevent it from rotating in their hands. This specialization improves the function of the goalie stick during saves by providing increased resistance to the torque generated from ball contact. This specialization can also assist with instructing young players learning how to play goalie. The specialization achieves this by requiring a lighter grip by the hand, because there is a larger structure to grip where this lighter grip allows faster reactions to shots.

A head for a lacrosse stick includes a socket defining a female aperture for receiving a lacrosse shaft therein. The socket and the lacrosse shaft being longitudinally aligned along a stick axis in a throat region. A frame member is connected to the socket member and defines a number of holes therethrough for attachment of flexible pocket material thereto. The frame member includes a front open end with a front edge and a closed rear end with a rear edge and defining a frame axis longitudinally through a center axis of the frame member. The frame defines a generally planar surface having a front facing direction that is substantially perpendicular thereto. Therefore, the present invention includes an anti-rotation element that is either provided on the shaft itself, the head/frame itself or included an adapter that is attached between the shaft and the goalie stick head generally near the female aperture of the goalie head into which the shaft is inserted.

In view of the above, an object of the present invention is to provide an anti-rotation element that increases the front to back cross-sectional dimension of the shaft compared to the side to side width cross-sectional dimension thus increasing the anti-rotational torque a goalie can apply to the shaft for a given grip strength.

A further object of the present invention is to provide an anti-rotation element that is secured to or incorporated into a shaft of a lacrosse goalie stick.

Another object of the present invention is to provide an anti-rotation element that is secured to or is incorporated into the goalie head of a lacrosse goalie stick.

Another object of the present invention is to provide an anti-rotation element that is secured to or incorporated into an adapter that is secured between the shaft and the head of a lacrosse goalie stick.

Yet another object of the present invention is to increase resistance to rotational torque about the longitudinal axis of the shaft to decrease the risk of an off-center shot that rotates a lacrosse goalie stick that would allow a ball to pass and perhaps result in a score.

A further object of the present invention is to increase the chances of a goalie making a save.

A further object of the present invention is to provide aid in instructing goalies to not grip the shaft too tightly with their hands as the circumference of the shaft has been increased. A grip that is not too tight increases the speed with which a goalie can move their hands, thus increasing a goalies ability to make a save.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE INVENTION

Figure 1:
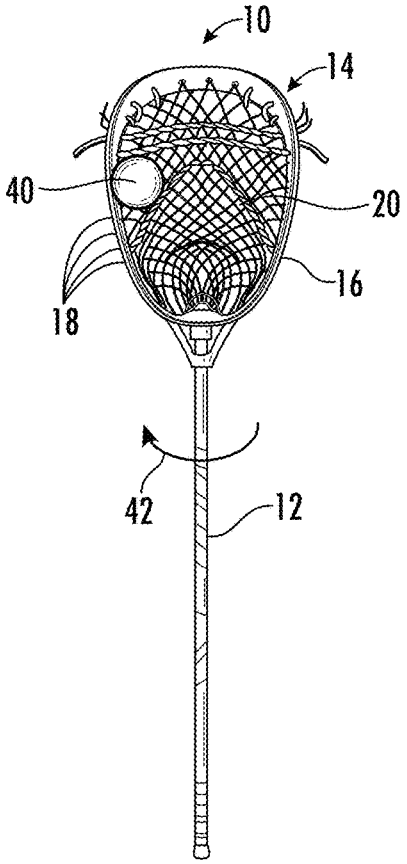
FIG. 1 PRIOR ART
FIGS. 1-5 show a known lacrosse goalie stick.
Figure 2:
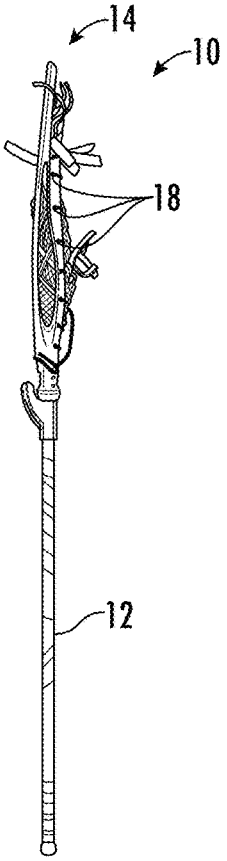
FIG. 2 PRIOR ART
Figure 3:
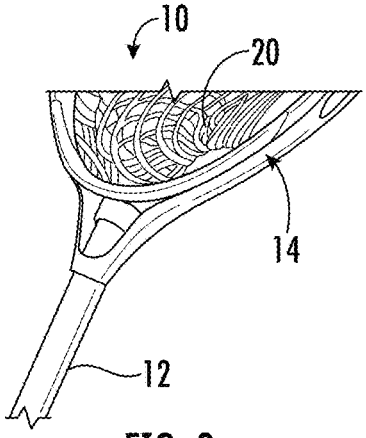
FIG. 3 PRIOR ART
Figure 4:
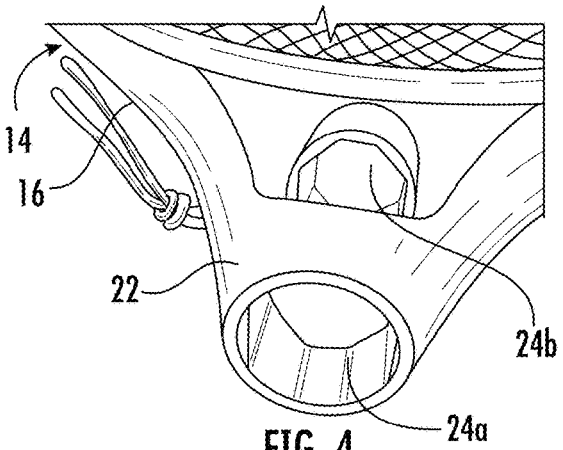
FIG. 4 PRIOR ART
Figure 5:
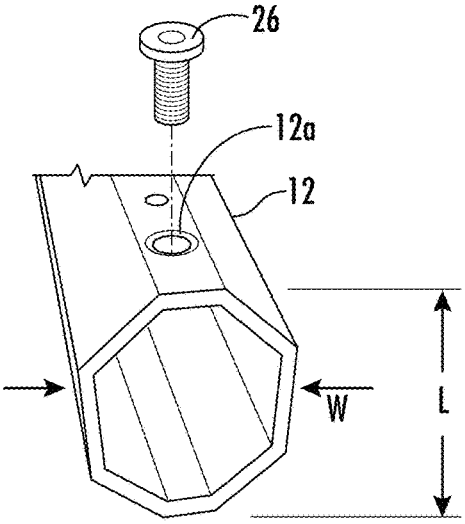
FIG. 5 PRIOR ART

Referring first to FIGS. 1-5, a known prior art goalie lacrosse stick 10 is shown. FIG. 1 shows a front view, FIG. 2 shows a side view, FIG. 3 shows a close-up view of the interconnection of the shaft 12 to the head 14 of the lacrosse stick, FIG. 4 shows the coupling portion of the head, and FIG. 5 shows the shaft of the lacrosse stick.

The prior art known lacrosse goalie stick 10 includes a stick portion 12 and head portion 14 that includes a frame 16. The frame 16 includes a number of holes 18 therethrough for attachment of the pocket 20 via use of the usual known strings and laces.

The head 14 is connected to the shaft 12 via the throat coupling portion 22. The throat coupling portion 22 includes a female pass through 24*a* into seat 24*b* for receiving the shaft 12 in releasable fashion. A fastener 26, such as a screw is secured through a wall of the throat coupling portion 22 and then into the shaft 12, such as via hole 12*a*. This attachment of a shaft 12 to a lacrosse goalie stick head 14 via a throat portion 22 is so well known in the art that it need not be discussed further in detail herein. As in FIG. 1, an off center hit of a ball 40 to frame 14 results in unwanted torquing 42 of the entire stick 10.

As seen in FIG. 5, the shaft portion is substantially symmetrical in cross-sectional dimensional where the width W is substantially the same as the front to back length L. It is possible that known goalie lacrosse sticks 10 have a width W that is less than the front to back length L but it is not substantially more. Most importantly, the front to back length L of known a shaft 12 is not enough to assist the player in providing enough anti-rotational force to prevent rotation of the stick 10, and therefore, prevent anti-rotation of the head 14 of the goalie lacrosse stick 10. The front to back length L must be much more than the transverse width W of the shaft to effectively assist the player to prevent rotation of the shaft 12 and, thus, the overall goalie lacrosse stick 10.

Referring now to FIGS. 6-17, an anti-rotation element 26 of the present invention is provided in the form of an adapter 26 that is installed on a lacrosse goalie stick 10 of the present invention. The adapter 26 includes an integrated anti-rotation element 28.

Figure 6:
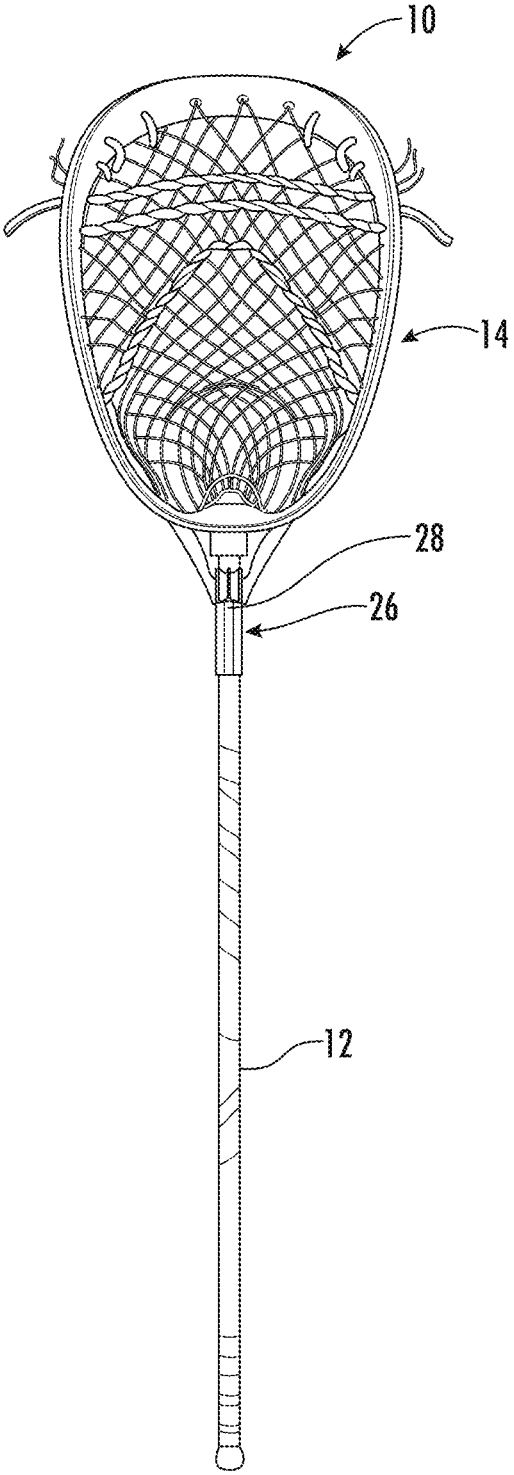
FIG. 6 shows a front view of a first embodiment of the anti-rotation element for a lacrosse goalie stick of the present invention equipped with an adapter with integrated anti-rotation element of the present invention.
Figure 7:
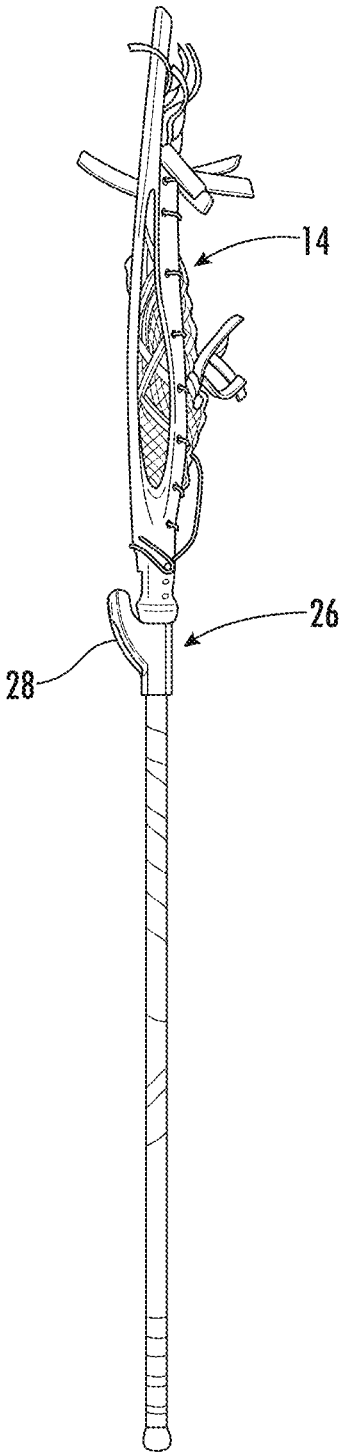
FIG. 7 shows a side view of the lacrosse stick of FIG. 6.
Figure 8:
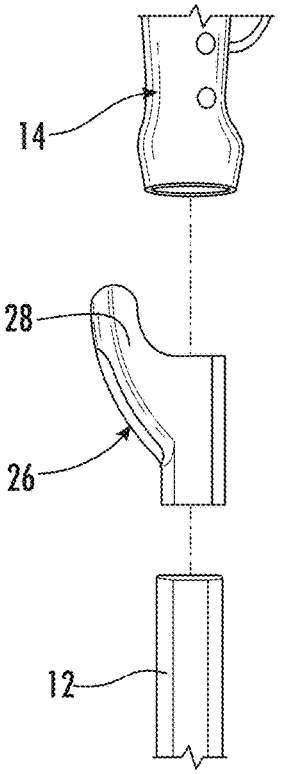
FIG. 8 shows an exploded view of the lacrosse stick of FIG. 6.
Figure 9:
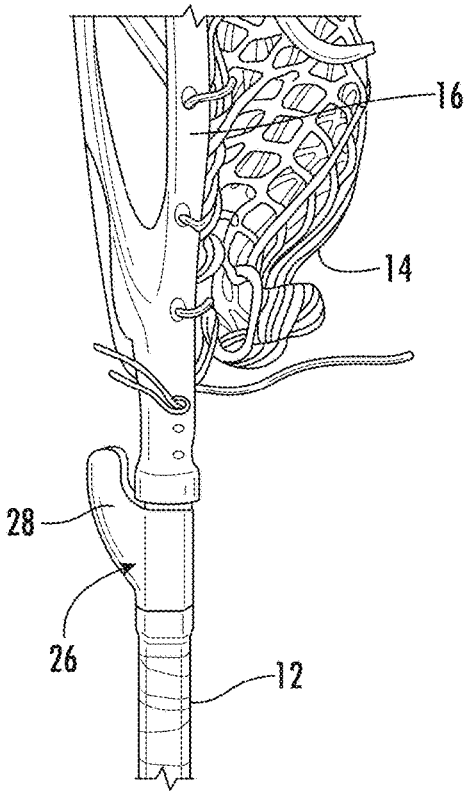
FIG. 9 shows a close up assembled view of the lacrosse stick of FIG. 6.
Figure 10:
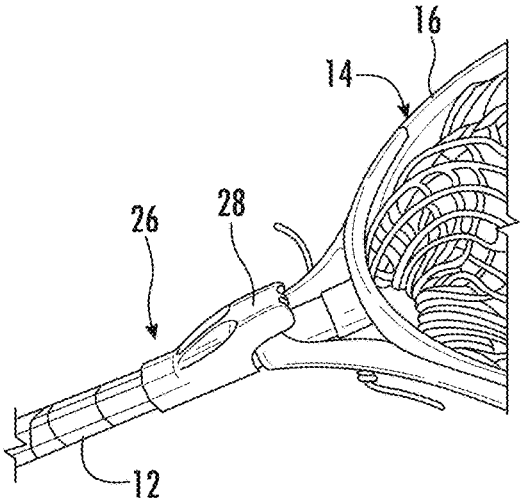
FIG. 10 shows a perspective view of the lacrosse stick of FIG. 6.
Figure 11:
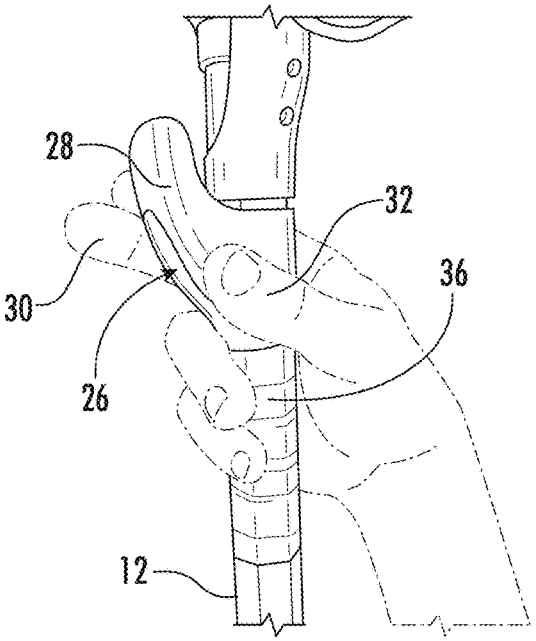
FIG. 11 shows the lacrosse stick of FIG. 6 in use.

In FIGS. 6 and 7, a goalie lacrosse stick 10 is shown to include the usual shaft and head. However, a new and novel adapter member 26 is installed on the shaft 12. The adapter member 26 includes a preferably integrated anti-rotation member 28 that greatly increases the differential between the front to back length L of the shaft 12 compared to the width W. FIG. 8 shows an exploded view of the adapter 26, shaft 12 and the stick head 14. FIG. 9 shows a close up assembled view of the lacrosse stick of FIG. 6 where the increased length L is much greater than the dimension W. FIGS. 10 and 11 show views of the lacrosse stick 10 of FIG. 6 with the adapter member 26 is fully installed and in use. As in FIG. 11, the player can grip the goalie lacrosse stick 10 with their fingers 30 and thumb 32, for example, on opposing sides of the adapter anti-rotation element 26 whereby such positioning of the fingers 30 and thumb 32 creates sufficient leverage to prevent rotation of the shaft 12 about its longitudinal axis without the player needing to grip the shaft 12 with added grip force. Thus, this additional anti-rotation element helps avoid an off-center contact of a shot ball 40 to the stick frame 16 from torquing the entire stick 10, at 42 as in FIG. 1, to effectively increase the chances of save and avoiding a goal. Further, as stated above, the ability to prevent torque of the lacrosse stick head 14 without an excessively tight grip promotes proper goalie stick handling.

Figure 12:
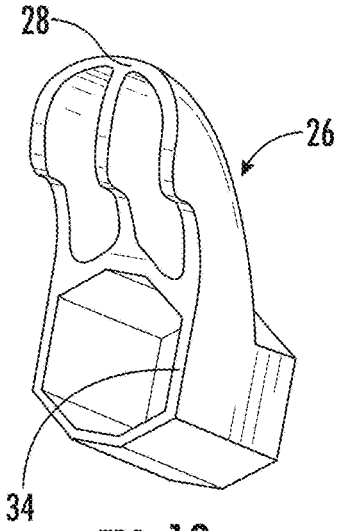
FIGS. 12-17 shows various views of the adapter with anti-rotation element used in connection with the goalie lacrosse stick of FIG. 6.
Figure 13:
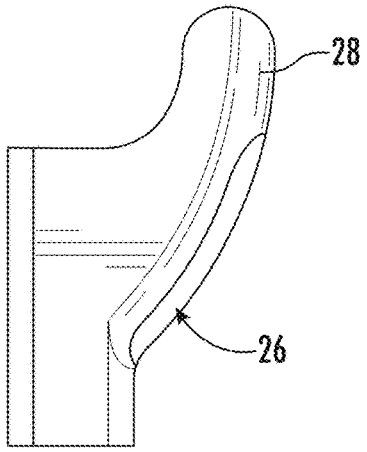
Figure 14:
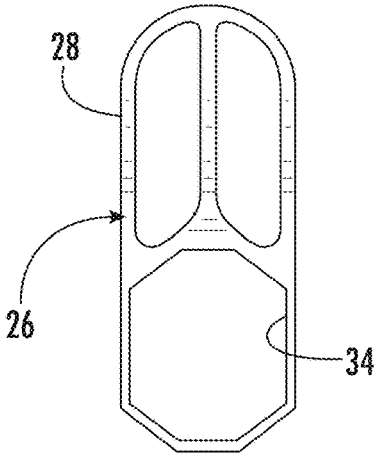
Figure 15:
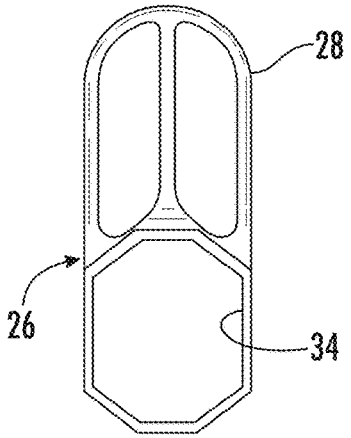
Figure 16:
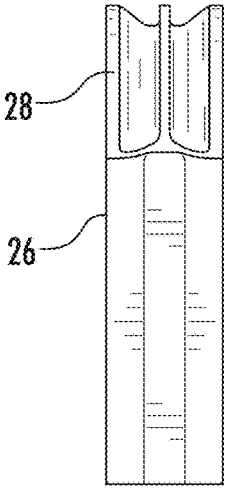
Figure 17:
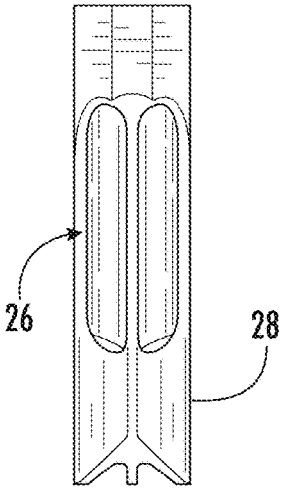

FIGS. 12-17 shows various views of the adapter 26 used in connection with the goalie lacrosse stick 10 of FIG. 6. FIG. 12 shows a top perspective view of the adapter 26 with a pass-through aperture 34 through which the shaft 12 is routed. The aperture 34 is sized and configured similar to the female aperture 24*a* to receive the shaft 12 therethrough. Since the slidable mating interface is not circular, it is rotationally keyed. FIG. 13 shows a side view of the adapter 26 with its anti-rotation element portion 28. FIG. 14 shows a top view of the adapter 26 while FIG. 15 shows a bottom view of the adapter 26. FIG. 16 shows a front view and FIG. 17 shows a rear view. The anti-rotation element 28 is preferably configured to be curved in an upward directed but can be configured and arranged as any other structure, such as a planar member or circular member. However, it is preferred that the anti-rotation member 26 extends outwardly and upwardly above the frame coupling 22, when installed, the anti-rotation member 28 extends in front of the goalie stick head 14 to provide the increased from to back length distance L. Different shapes and sizes are envision to suit the preferences of the player.

The adapter 26 is slid over the top of the shaft 12 and then the shaft 12 is secured to the stick head 14 in the usual fashion via the coupling 22 using a threaded fastener 26, or the like. The adapter 26 is preferably slid up the shaft 12 until it stops against the bottom of the head coupling 22 and then it is secured in place preferably using tape 36 in FIG. 11, or the like. Other ways to secure the adapter in place are possible, such as by fasteners or adhesive. It is possible to secure the adapter 26 in place at any position along the length of the shaft 12 to suit the needs of the player. It is also possible to install the adapter 26 in a reverse configuration with the anti-rotation element 28 facing rearwardly instead (not shown). It is even further possible that a second anti-rotation element (not shown) be provided in the rear side of the adapter 26 to provide a second leverage structure to assist in anti-rotation of the shaft 12.

As can be understood, the engagement of the non-circular shaft 12 to the complementary adapter 26 provide the necessary rotational keying to avoid the aforesaid undesirable head torquing from off-center hits to the head 14 of the goalie lacrosse stick 10. This adapter 26 with anti-rotational element 28 thereon provide stick performance to the player that is not possible in prior art goalie stick configurations.

Figure 18:
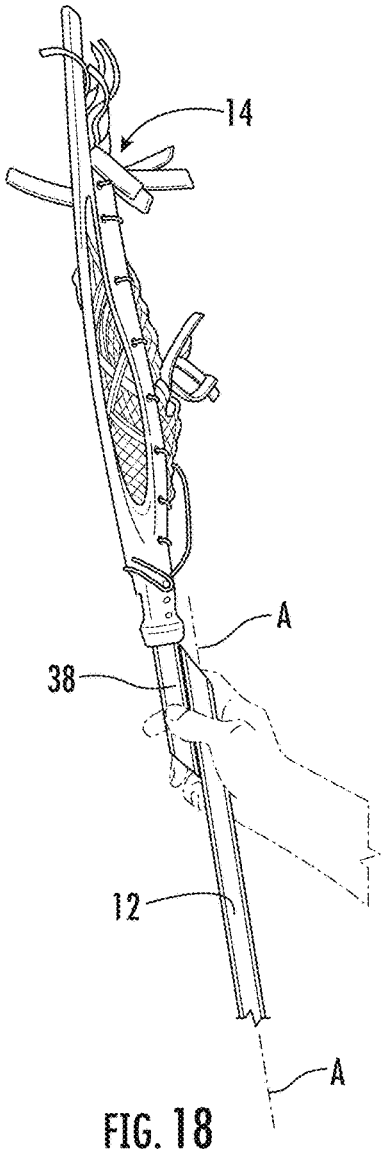
FIG. 18 shows a second embodiment of the present invention with anti-rotation element integrated into a shaft of a goalie lacrosse stick.
Figure 19:
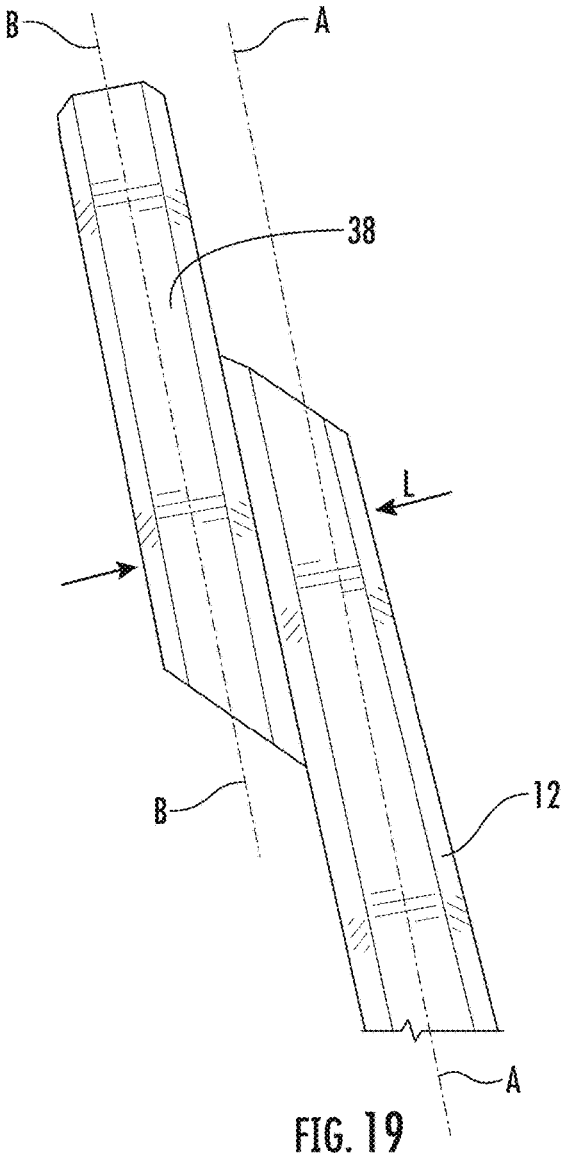
FIG. 19 shows a close up view of the shaft used in the lacrosse stick of FIG. 18.
Figure 20:
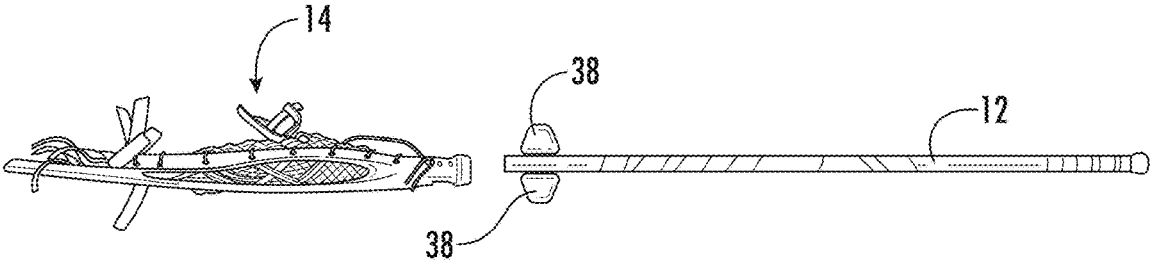
FIG. 20 shows a modified version of the lacrosse stick of FIG. 18.

Turning now to FIGS. 18-20, a second embodiment of the present invention is shown. FIG. 18 shows an anti-rotation element 38 that is integrated into or otherwise connected to the shaft 12 of a goalie lacrosse stick. A close up view of the shaft 12 of the second embodiment of the present invention is shown FIG. 19 where the new and novel anti-rotation element 38 of the present invention is provided as a forward offset member that is forward of the longitudinal axis A of the main body of the shaft, namely on an axis B. Such an offset B effectively provides a similar front to back increased dimension length L compared to the width W of the shaft. The width W in the second embodiment is the same as a width of a standard shaft 12. As can be understood, the additional front to back length L provides additional gripping area, as in FIG. 18, to help avoid rotational torquing of the shaft 12 and, in turn, rotational torquing 42 of the goalie stick head 14 so the player can save a ball 40 that hits off center to the head of the goalie stick.

FIG. 20 provides a slightly modified version of the second embodiment of the present invention where the anti-rotation element 38 is provided as a lateral extension to the shaft 12 instead of an offset-type member. Also, FIG. 20 shows that it is also possible that a second anti-rotation element 38 can be provided on the rear side of the shaft 12 to provide even further anti-rotation capabilities. The anti-rotation elements 38 can be half-moon shaped, as shown, or they can be of any configuration as long as they extend the front to back length L of the shaft to provide the anti-rotation capabilities of the present invention.

Figure 21:
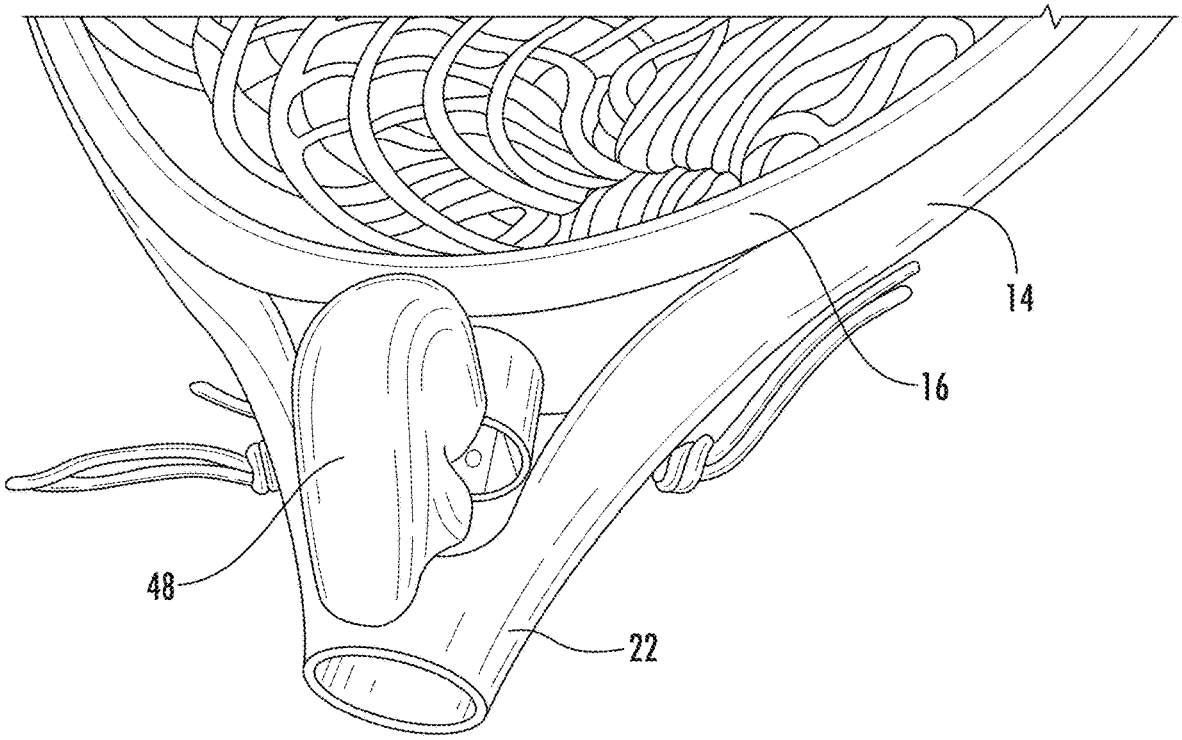
FIG. 21 shows a third embodiment of an anti-rotation element of the present invention that is located on the head of the lacrosse stick.

A third embodiment of the present invention is shown in FIG. 21 where an anti-rotation element 48 is located directly on the head 14 of the lacrosse stick 10. In this case, the anti-rotation element 48 may be integrally molded with the head 14 or it may separately formed and then secured to the head 14. In this case, during gameplay, the player grabs the head 14 with fingers 30 and thumb 32 communicating with the head 14, as above, and the anti-rotation element 48 provides the anti-rotation capabilities to avoid unwanted torquing 42 of the overall stick 10.

The adapter 26 and its anti-rotation element 28 of the first embodiment, the added member 38 to the shaft 12 of the second embodiment, and the added member 48 to the head 14 of the lacrosse goalie stick 10 of the third embodiment can be made in any way and out any material that is suitable for lacrosse goalie stick heads 14. For example, the adapter lacrosse goalie stick head 114 of the present invention can be 3D printed, molded or otherwise formed of plastic or any other material, such as a metal. In the second embodiment, the added member 38 can be an additional portion of shaft material that is secured on the front portion of the shaft 12 to the provide the desired increased front to back length dimension L. Or, the added member 38 can be a separate member of any shape or configuration. In the third embodiment, the added member 48 can be integrally molded with the head 14 of the stick or it can be separately 3D printed, molded or otherwise formed as a separate member that is affixed on to the head 14, such as by fasteners 26, adhesive, or the like.

In view of the above, a new and novel anti-rotation element 26, 38, 48 is provided for a goalie lacrosse stick 10 is provided in accordance with the present invention. Many options and configurations are provided and are within the scope of the present invention to provide a lacrosse goalie stick 10 that has a greatly increased front to back length L, compared to the transverse width W, for anti-rotation capabilities to avoid undesirable torquing of the stick 10 to achieve a save and avoid an unwanted goal. While the present invention has particularly applicability and use for lacrosse goalie sticks, it may also be used for lacrosse field sticks.

It would be appreciated by those skilled in the art that various changes and modifications can be made to the illustrated embodiments without departing from the spirit of the present invention. All such modifications and changes are intended to be covered by the appended claims.

What is claimed is:

1. An anti-rotation adapter for a goalie lacrosse stick having a goalie stick head with a forward facing direction that includes a front to back path running therethrough, the goalie stick head having a female connector with a lower edge and pass through port, a free end of a shaft with a longitudinal axis being slidably inserted into the female connector of the goalie stick head, comprising:

a grip member having a main body with a non-symmetrical shape with a cross-sectional length dimension that is longer than a cross-sectional width dimension; the grip member having longitudinally top end and a longitudinally bottom end;

the grip member defining a longitudinal pass-through aperture through which the shaft is longitudinally slidably routed; the grip member being slidably positionable along the shaft with the longitudinally top end of the grip member being adjacent to the lower edge of the female connector of the goalie stick head;

the grip member including an anti-rotation member emanating laterally from the main body and extending upwardly past the lower edge of the female connector of the goalie stick head;

the grip member being oriented with its cross-sectional length running front to back and substantially aligned with the front to back path;

wherein gripping of the grip member above the lower edge of the female connector of the goalie stick head assists in preventing rotation of the shaft about the longitudinal axis for improved stability of the goalie lacrosse stick.

2. The anti-rotation adapter for a goalie lacrosse stick of claim 1, wherein the anti-rotation member has an arcuate shape extending upwardly toward the goalie stick head.

3. The anti-rotation adapter for a goalie lacrosse stick of claim 1, wherein the anti-rotation member has a width that is the same as the main body of the adapter.

4. The anti-rotation adapter for a goalie lacrosse stick of claim 1, wherein the shaft has an octagonal outer profile and the longitudinal pass-through aperture of the main body of the adapter has a complementary inner octagonal profile whereby the adapter is rotationally keyed relative to the shaft.

* * * * *